US007673953B2

(12) United States Patent
Yamashita

(10) Patent No.: US 7,673,953 B2
(45) Date of Patent: Mar. 9, 2010

(54) LIQUID EJECTION APPARATUS FOR SUPPRESSING A DECREASE IN SPEED OF LIQUID DROPLETS WHICH ARE DISCHARGED FROM ADJACENT NOZZLES DURING THE SAME DISCHARGE PERIOD

(75) Inventor: Noriaki Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 306 days.

(21) Appl. No.: 11/754,114

(22) Filed: May 25, 2007

(65) Prior Publication Data

US 2007/0273719 A1 Nov. 29, 2007

(30) Foreign Application Priority Data

May 25, 2006 (JP) ..... 2006-145844

(51) Int. Cl.
*B41J 29/38* (2006.01)
*B41J 2/205* (2006.01)

(52) U.S. Cl. ..... 347/11; 347/15

(58) Field of Classification Search ..... 347/11
See application file for complete search history.

(56) References Cited

U.S. PATENT DOCUMENTS 6,106,092 A * 8/2000 Norigoe et al. ..... 347/11
6,494,554 B1 * 12/2002 Horii et al. ..... 347/11
7,556,338 B2 * 7/2009 Iriguchi ..... 347/12
2004/0125158 A1 * 7/2004 Groninger et al. ..... 347/9
2006/0038840 A1 * 2/2006 Usui ..... 347/11
2006/0061609 A1 * 3/2006 Okuda et al. ..... 347/10

FOREIGN PATENT DOCUMENTS

EP 1023999 A2 * 8/2000
JP 2000-211130 8/2000
JP 2005-088582 4/2005

* cited by examiner

*Primary Examiner*—Matthew Luu
*Assistant Examiner*—Shelby Fidler
(74) *Attorney, Agent, or Firm*—Workman Nydegger

(57) ABSTRACT

A liquid ejecting apparatus including a pressure generating unit capable of changing a pressure of liquid contained in the pressure chamber, a liquid ejecting head capable of discharging liquid droplets from a nozzle opening by actuating the pressure generating unit, a passage extending from a common liquid chamber through a pressure chamber to the nozzle opening and a driving signal generating unit that repeatedly generates a plurality of driving signals causing the liquid droplets to be discharged by actuating the pressure generating unit. In order to prevent the vibration resulting from a first driving pulse sent to a first pressure generating unit from interfering with the discharge in an adjacent pressure chamber, a second driving signal including a second discharge pulse, is generated at a period of time after to the first discharge pulse corresponding to a characteristic vibration period of the liquid contained in the pressure chamber.

2 Claims, 8 Drawing Sheets

LIQUID EJECTION APPARATUS FOR SUPPRESSING A DECREASE IN SPEED OF LIQUID DROPLETS WHICH ARE DISCHARGED FROM ADJACENT NOZZLES DURING THE SAME DISCHARGE PERIOD

BACKGROUND OF THE INVENTION

The entire disclosure of Japanese Patent Application No. 2006-145844, filed May 25, 2006 is expressly incorporated herein by reference.

1. Technical Field

The invention relates to a liquid ejecting apparatus and, more particularly, to a liquid ejecting apparatus capable of controlling the discharge of liquid droplets using a plurality of driving signals.

2. Related Art

Typically, a liquid ejecting apparatus has a liquid ejecting head capable of discharging liquid droplets of various liquids. An example of such a liquid ejecting apparatus is an ink jet recording apparatus, or printer, with an ink jet recording head (hereinafter, referred to as a recording head) which discharges liquid ink droplets from the recording head.

A liquid ejecting head is typically provided with pressure chambers such that a change in the pressure of the liquid contained in the pressure chamber occurs by actuating a pressure generating unit such as a piezoelectric vibrator. The ink then travels through a series of passages extending from the pressure chambers to a series of nozzles where it is discharged as ink droplets.

In recent years, ink jet recording apparatuses have been developed wherein a plurality of driving signals, comprised of discharge pulses which correspond to the different volumes of the ink droplets are sent to the piezoelectric vibrators (for example, see JP-A-2005-088582 (FIG. 5)). Advantageously, this allows for multi-valued gradation and improved speed in the recording process.

In recent years, however, the thicknesses of partitions between the pressure chambers has been decreased in order to decrease the weight and size of the recording head. As a result, a pressure vibration occurring in ink in one pressure chamber can reach the pressure chamber of a second nozzle and the velocity of ink droplets as they are being discharged from the second nozzle may be decreased. Particularly, when the ink droplets are discharged from adjacent nozzles using discharge pulses generated from different driving signals, there is a possibility that discharge of one nozzle will influence the discharge of the other nozzle.

When the velocity of the discharged ink droplets is decreased, the droplets may enter a mist state and fail to successfully hit the discharge target, thereby deteriorating the quality the resulting image.

BRIEF SUMMARY OF THE INVENTION

An advantage of some aspects of the invention is a liquid ejecting apparatus which can suppress the decrease in a the speed of liquid droplet which are discharged from adjacent nozzles during the same discharge period.

One aspect of the invention is a liquid ejecting apparatus including a pressure generating unit capable of changing the pressure of a liquid contained in the pressure chamber; a liquid ejecting head that can discharge liquid droplets from a nozzle opening by actuating the pressure generating unit; a passage extending from the pressure chamber to the nozzle; and a driving signal generating unit capable of generating a plurality of driving signals comprising a discharge pulse which causes the liquid droplets to be discharged by actuating the pressure generating unit, wherein the driving signal generating unit generates a first driving signal comprising a first discharge pulse and a second driving signal comprising a second discharge pulse, wherein the second discharge pulse is generated at a period of time after to the first discharge pulse, wherein the period of time between the beginning of the first discharge pulse and the end of the second discharge pulse corresponds to a characteristic vibration period of the liquid contained in the pressure chamber.

A second aspect of the present invention is a method for ejecting a liquid in a liquid ejecting apparatus including a pressure generating unit capable of changing a pressure of liquid contained in the pressure chamber, a liquid ejecting head capable of discharging liquid droplets from a nozzle opening by actuating the pressure generating unit, a passage extending from the pressure chamber to the nozzle, and a driving signal generating unit capable of generating a plurality of driving signals comprising discharge pulses which cause the liquid droplets to be discharged by actuating the pressure generating unit. The method comprises generating a first driving signal comprising a first discharge pulse and a second driving signal comprising a second discharge pulse, and delaying the time of the generation of the second discharge pulse so that the time between a start point of the first discharge pulse and an end point the second discharge pulse correspond to a characteristic vibration period of the liquid contained in the pressure chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments for carrying out the invention will be described with reference to the accompanying drawings. Although various detailed examples of the invention are given in the embodiments described below, but the scope of the invention is not limited to the embodiments unless specific imitations are described. Hereinafter, an ink jet recording apparatus (referred to as a printer) is included as an example of a liquid ejecting apparatus which may be used in association with the present invention.

Figure 1:
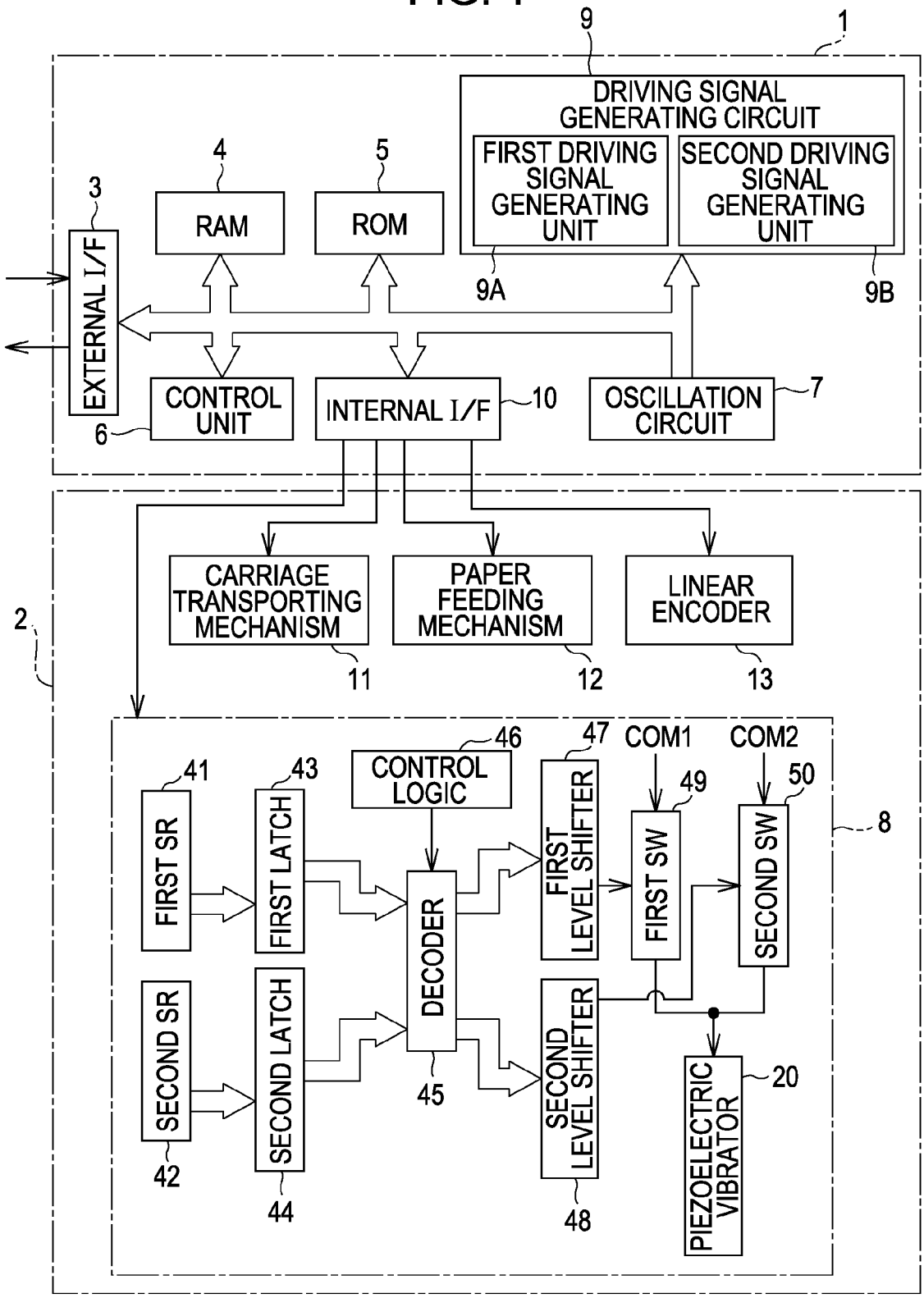
FIG. 1 is a functional block diagram of an ink jet printer.

FIG. 1 is a block diagram illustrating an electrical configuration of a printer. The exemplified printer includes a printer controller 1 and a printer engine 2. The printer controller 1 is provided with an external interface (external I/F) 3 that transmits and receives data to and from an external apparatus such as a host computer (not shown), a RAM 4 that stores various kinds of data, a ROM 5 that stores a control program for processing various kinds of data, a control unit 6 including a CPU, an oscillation circuit 7 that generates a clock signal, a driving signal generating circuit 9 that generates driving signals (COM1 and COM2) supplied to a recording head 8, and an internal interface (internal I/F) 10 that transmits recording data and the driving signals to the printer engine 2.

The external I/F 3 receives print data such as image data supplied from the host computer. Status signals such as a busy signal or an acknowledgement signal are output from the external I/F 3 to the external apparatus. The RAM 4 is used as a receiving buffer, an intermediate buffer, an output buffer, and a work memory unit. The ROM 5 stores various control programs which may be executed by the control unit 6, font data and code for executing graphic functions, and various other procedures.

The driving signal generating circuit 9 is provided with a first driving signal generating unit 9A capable of generating a first driving signal COM1 and a second driving signal generating unit 9B capable of generating a second driving signal COM2, which will be described more fully below.

The control unit 6 controls units of the printer in accordance with the control program stored in the ROM 5 or converts the print data supplied from external apparatuses to recording data that may be transmitted to the recording head 8. At the time of converting the print data to the recording data the control unit 6 first reads the print data stored in the RAM 4. Then the control unit 6 converts the read data into intermediate code data and stores the intermediate code data in an intermediate buffer provided in the RAM 4. Next, the control unit 6 analyzes the intermediate code data read from the intermediate buffer and converts the intermediate code data into the recording data (dot pattern data) for each dot by referring to font data and code for executing graphic functions stored in the ROM 5. The control unit 6 supplies a latch signal or a channel signal to the recording head 8 through the internal I/F 10. A latch pulse and a channel pulse included in the latch signal and the channel signal define a supply timing of each of the pulses constituting the driving signals COM1 and COM2.

Next, the print engine 2 will be described. As shown in FIG. 1, the printer engine 2 is provided with the recording head 8, a carriage mechanism 11, a paper feeding mechanism 12, and a linear encoder 13. The carriage mechanism 11 includes a carriage having the recording head, which is a kind of liquid ejecting head 8, attached thereto and a driving motor (such as a DC motor) that drives the carriage through a timing belt (carriage and driving motor not shown), and transports the recording head 8 mounted on the carriage in a main scanning direction. The paper feeding mechanism 12 includes a paper feeding motor and a paper feeding roller. The paper feeding mechanism 12 discharges recording sheets onto a platen and performs vertical scanning. The linear encoder 13 outputs an encoder pulse, which indicates the scanning position of the recording head 8 mounted on the carriage to the control unit 6 to the internal I/F 10 in the main scanning direction. The control unit 6 is then able to store the position of the recording head 8.

Figure 2:
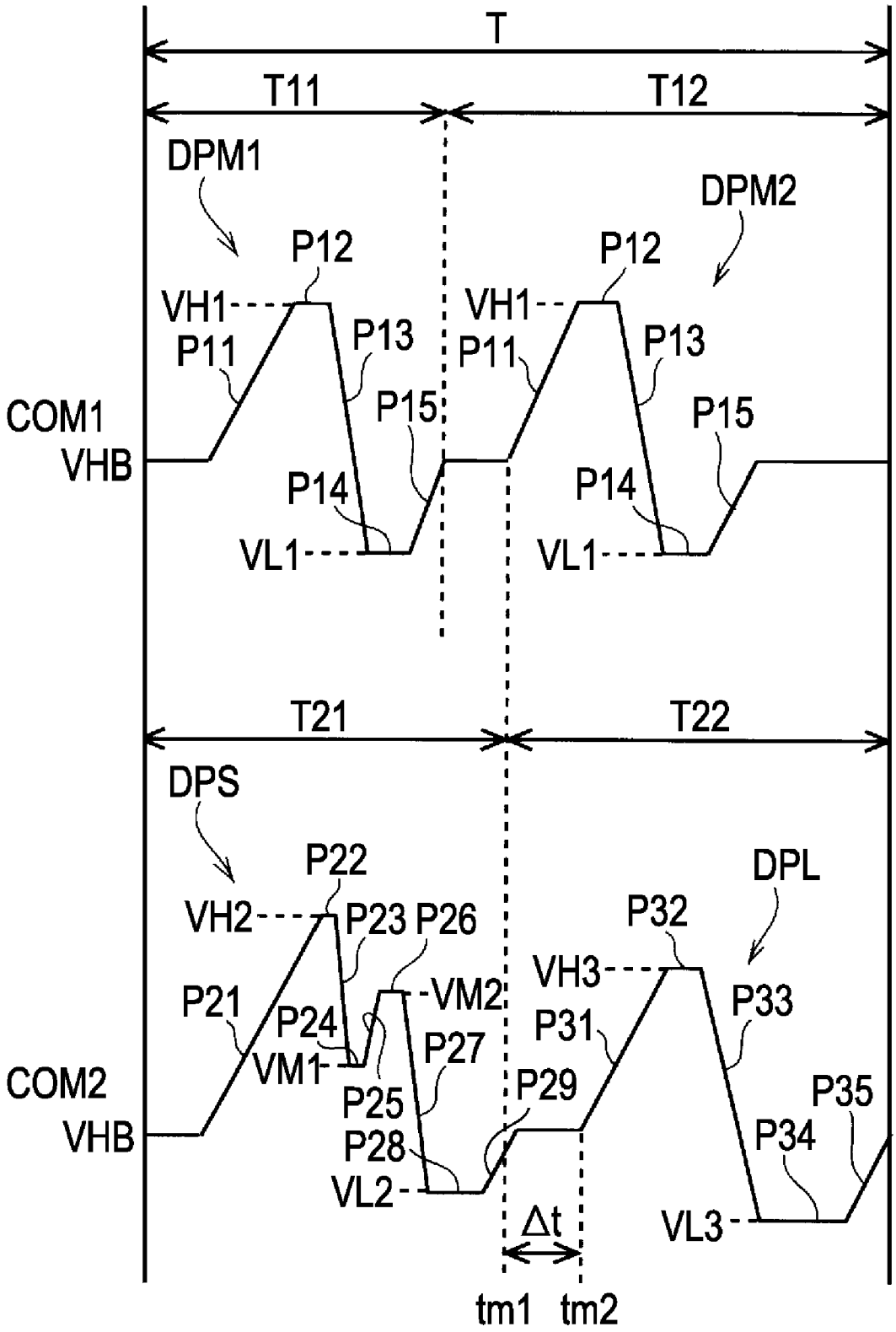
FIG. 2 is a diagram illustrating a configuration of a driving signal.

As shown in FIG. 2, the first driving signal COM1 is a signal having a first discharge pulse DPM1 sufficient to generate a first medium-sized printing dot and a second medium-size dot discharge pulse DPM2 in a recording period T. The first driving signal COM1 is generated each recording period T. In the embodiment, one recording period T of the first driving signal COM1 is divided into two periods T11 and T12. In the first driving signal COM1, the first medium-size dot discharge pulse DPM1 is generated in the period T11 and the second medium-size dot discharge pulse DPM2 is generated in the period T12.

The second driving signal COM2 is a signal having a small dot discharge pulse DPS and a large dot discharge pulse DPL within the recording period T. One recording period T of the second driving signal COM2 is divided into two pulse generation periods of T21 and T22. The small dot discharge pulse DPS is generated in the period T21 and the large dot discharge pulse DPL is generated in the period T22. The driving signals COM1 and COM2 will be described in greater detail below.

Figure 3:
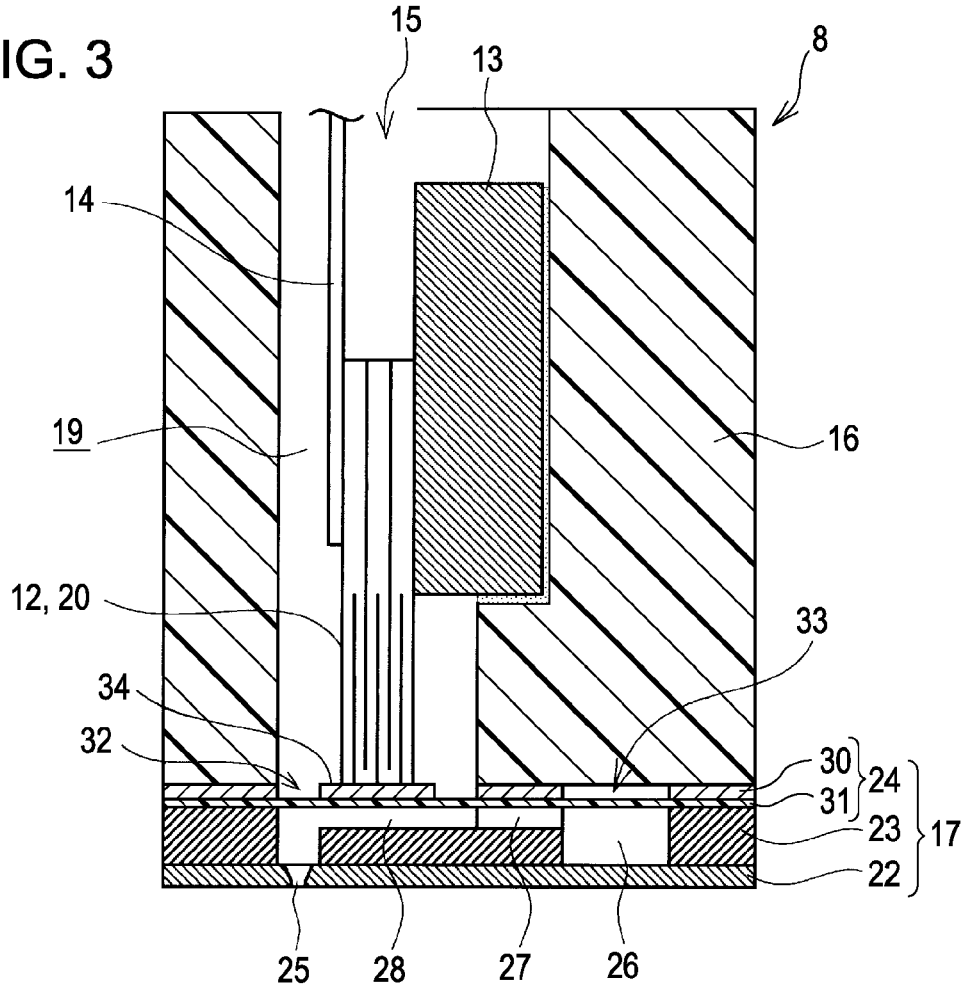
FIG. 3 is a cross-sectional view illustrating main units of a recording head.

FIG. 3 is a cross-sectional view illustrating the main units of the recording head 8. The recording head 8 according to the embodiment is provided with, a vibrator unit 15 including a piezoelectric vibrator portion 12, a clamping plate 13, and a flexible cable 14, a head case 16 capable of housing the vibrator unit 15, and a series of passages 17 extending from ink chambers, through pressure chambers, and then to nozzle openings.

First, the vibrator unit 15 will be described. Piezoelectric vibrators 20 within the piezoelectric vibrator portion 12 are formed in an elongated comb-like shape in the longitudinal direction. Each of the piezoelectric vibrators 20 has a very small width of approximately several tens of μms. Each of the piezoelectric vibrators 20 is a piezoelectric vibrator of the longitudinal vibration type which is capable of extending in the longitudinal direction. A fixing end portion is bonded onto the clamping plate 13 and a free end portion protrudes outside a leading edge of the clamping plate 13, meaning that each of the piezoelectric vibrators 20 is fixed in a so-called cantilever state. A front end of the free end portion of each of the piezoelectric vibrators 20 is bonded to an island section 34 constituting a diaphragm section 32 in each of the passage units 17 as described below. The flexible cable 14 is electrically connected to the piezoelectric vibrator 20 on a side surface of a fixing end portion opposite the clamping plate 13. The clamping plate 13 supporting each of the piezoelectric vibrators 20 is formed from a metallic plate material having a rigidity such that it can receive a reaction force from the piezoelectric vibrators 20. In this embodiment, the clamping plate 13 is composed of a stainless steel plate having a thickness of approximately 1 mm.

Next, the passage unit 17 will be described. The passage 17 is formed in a nozzle plate 22, a passage formation substrate 23, and a vibrating plate 24. The passage 17 is creating by disposing and laminating the nozzle plate 22 on one surface of the passage substrate 23 and disposing and laminating the vibrating plate 24 on the other surface of the passage formation substrate 23 bonding the nozzle plate 22 to the vibrating plate 24.

The nozzle plate 22 is a thin plate formed of stainless steel with a plurality of nozzle openings 25 formed in an array with a pitch corresponding to a dot formation concentration. In the embodiment, for example, 180 nozzle openings 25 are formed in an array in order to create a nozzle array. Two nozzle arrays are provided parallel to each other.

The passage formation substrate 23 is a plate-like member forming an ink passage including a reservoir 26, ink supply port 27, and a pressure chamber 28. Specifically, the passage formation substrate 23 is a plate-like member in which a plurality of null portions serve as pressure chambers 28 which are separated by partitions with nozzle openings 25 and null portions serving as ink supply ports 27 and reservoirs 26. According to one embodiment, the passage formation substrate 23 is manufactured by etching a silicon wafer. The pressure chambers 28 are formed into elongated chambers in a direction orthogonal to the direction of the nozzle array of nozzle openings 25. Each of the ink supply ports 27 are formed into a narrow portion having a small passage width, which allows the pressure chamber 28 to communicate with the reservoir 26. Each of the reservoirs 26 is a chamber for transferring ink stored in an ink cartridge (not shown) into the corresponding pressure chamber 28 through the ink supply port 27.

The vibrating plate 24 is a composite plate material having a two-layer structure in which a resin film 31 such as PPS (polyphenylene sulfide) is laminated on a metallic supporting plate 30 formed of a material such as stainless steel. The vibrating plate 24 has a diaphragm section 32 for varying the volume of the pressure chamber 28 by sealing one opening surface of the pressure chamber 28 along with a compliance section 33 for sealing one opening of the reservoir 26. In the diaphragm section 32, the island section 34 is formed by etching part of the supporting plate 30 corresponding to the pressure chamber 28 and by removing the surrounding portions. The island section 34 has an elongated block shape in the direction orthogonal to the direction of the array of nozzle openings 25. The resin film 31 is a resilient body film located near the island section 34. The portion corresponding to the reservoir 26 is referred to as the compliance section 33, which is formed above the resin film 31 by removing a portion of the supporting plate 30 that is roughly the same size as the opening shape of the reservoir 26 using an etching process.

Next, the electrical configuration of the recording head 8 will be described. As shown in FIG. 1, the recording head 8 is provided with a shift register circuit including a first shift register 41 and a second shift register 42, a latch circuit including a first latch circuit 43 and a second latch circuit 44, a decoder 45, a control logic circuit 46, a level shifter circuit including a first level shifter 47 and a second level shifter 48, a switch circuit including a first switch 49 and a second switch 50, and the piezoelectric vibrator 20. The shift registers 41 and 42, the latch circuits 43 and 44, the level shifters 47 and 48, the switches 49 and 50, and the piezoelectric vibrators 20 are included in a number equal to the number of the nozzle openings 25.

The recording head 8 discharges ink droplets on the basis of recording data received from a printer controller 1. In the embodiment, since a higher bit group of recording data and a lower bit group of recording data, each formed of two bits, are sent to the recording head 8 sequentially, the higher bit group of the recording data is set in the second shift register 42. At each nozzle openings 25, any higher bit group of recording data set in the second shift register 42 is shifted to the first shift register 41 and the lower bit group of the recording data is set in the second shift register 42.

The first latch circuit 43 is electrically connected to an end of the first shift register 41 and the second latch circuit 44 is electrically connected to an end of the second shift register 42. When a latch pulse from the printer controller 1 is sent to each of the latch circuits 43 and 44, the first latch circuit 43 latches the higher bit group of the recording data and the second latch circuit 44 latches the lower bit group of the recording data. The recording data (higher bit group and lower bit group) latched by the latch circuits 43 and 44 are then outputted to the decoder 45. The decoder 45 generates pulse selection data for selecting the pulses comprising the driving signals COM1 and COM2 based on the higher bit group and the lower bit group of the recording data.

According to one embodiment, pulse selection data is generated for each of the driving signals COM1 and COM2. That is to say, first pulse selection data corresponding to the first driving signal COM1 is configured by 2-bit data corresponding to the first medium-size dot discharge pulse DPM1 (the period T11) and the second medium-size dot discharge pulse DPM2 (the period T12). Second pulse selection data corresponding to the second driving signal COM2 is comprised of 2-bit data corresponding to the small dot discharge pulse DPS (the period T21) and the large dot discharge pulse DPL (the period T22).

A timing signal from the control logic circuit 46 is also input into the decoder 45. The control logic circuit 46 generates the timing signal in synchronization with input from the latch signal or the channel signal. The timing signal is also generated for each of the driving signals COM1 and COM2. Each pulse selection data generated by the decoder 45 is input into a corresponding level shifter 47 or 48 sequentially from a higher bit side at a timing defined by the timing signal. The level shifters 47 and 48 function as a voltage amplifier. The level shifters 47 and 48 output an electrical signal raised to a voltage sufficient to drive the corresponding switches 49 and 50. For example, a voltage of approximately several tens of volts may be used when the pulse selection data has a value of 1. When the first pulse selection data has a value of 1, the electrical signal may be output to the first switch 49 and when the second pulse selection data has a value of 1, the electrical signal may be output to the second switch 50.

The first driving signal COM1 is supplied from a first driving signal generating unit 9A to a first switch 49 and the second driving signal COM2 is supplied from a second driving signal generating unit 9B a second switch 50. In return, each of the piezoelectric vibrators 20 is connected to the corresponding switches 49 and 50. That is to say, the first switch 49 switches supply the first driving signal COM1 to the piezoelectric vibrator 20 and the second switch 50 switches supply the second driving signal COM2 to the piezoelectric vibrator 20. The first switch 49 and the second switch 50 selectively supply the driving signals.

The pulse selection data controls actuation of each of the switches 49 and 50. Thus, while the pulse selection data input sent to the first switch 49 has the value of 1, the first switch 49 is in a conduction state and a first driving signal COM1 is supplied to the piezoelectric vibrator 20. Similarly, while the pulse selection data input sent to the second switch 50 has the value of 1, a second driving signal COM2 is supplied to the piezoelectric vibrator 20. On the other hand, when the pulse selection data input sent to the switches 49 and 50 has a value of 0, each of the switches 49 and 50 is in a cut-off state and no driving signal is supplied to the piezoelectric vibrator 20. In other words, when the pulse data has the value of 1 a pulse is supplied to the piezoelectric vibrator 20 for a specified period of time.

Figure 10:
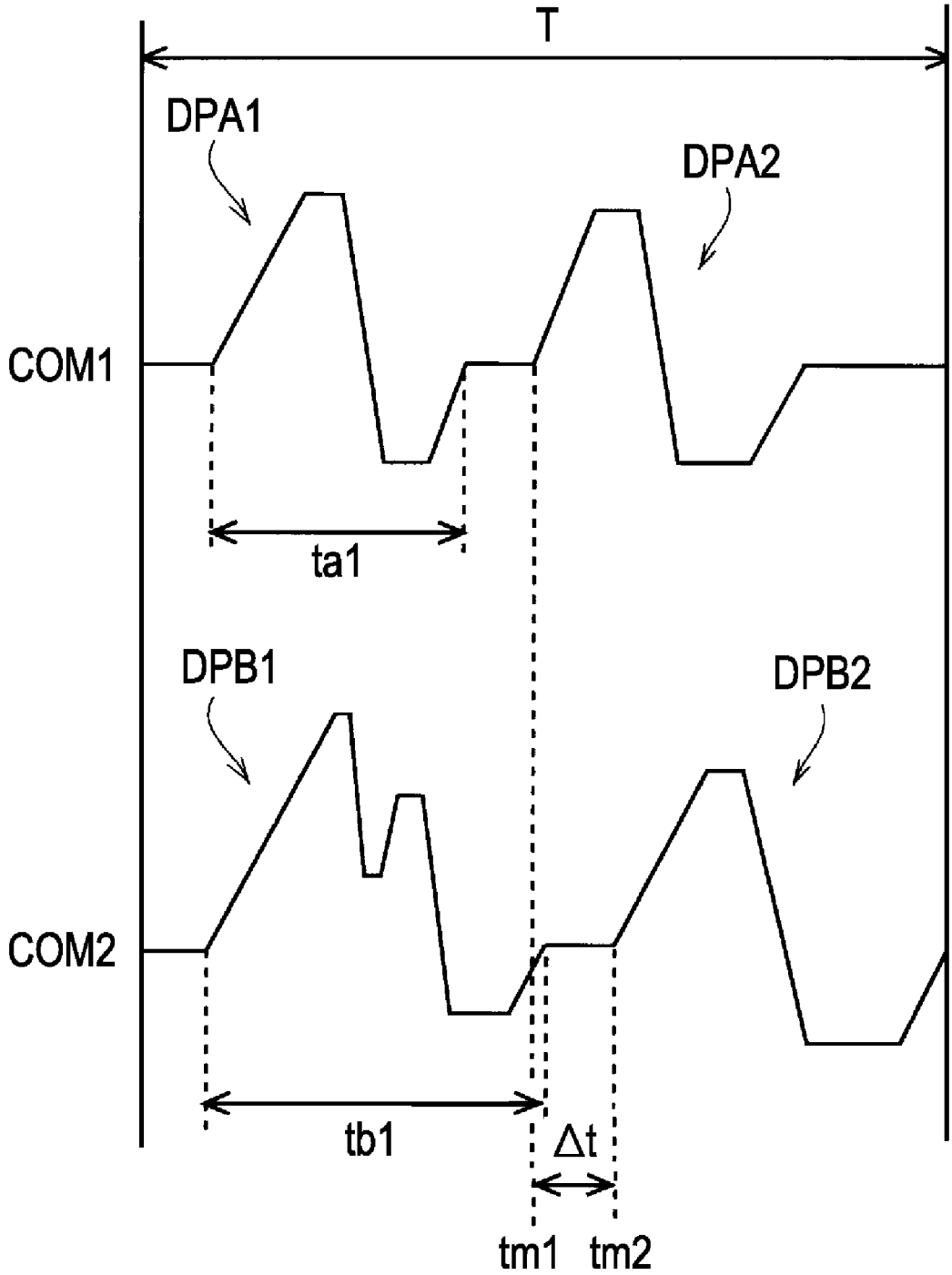
FIG. 10 is a diagram illustrating a configuration of a driving signal in a traditional printing apparatus.

Next, the discharge pulse included in each of the driving signals COM1 and COM2, which is generated by the driving signal generating circuit 9 will be described, in reference to FIGS. 2 and 10. FIG. 10 will describe the discharge pulses generally in reference to printing apparatuses currently used in the art, while FIG. 2 will explain aspects of the invention in greater detail.

FIG. 10 illustrates a configuration in which a generation time ta1 of a first discharge pulse DPA1 that is first generated in one driving signal COM1 is different from the generation time tb1 of the first discharge pulse DPB1 generated in another driving signal COM2. Because the spacing of the discharge pulses in the driving signals is reduced as much as possible in order to speed up the recording operation by shortening the length of one recording period T, the generation time tm1 of a discharge pulse DPA2 generated after the discharge pulse DPA1 may not match the generation timing tm2 of a discharge pulse DPB2. Thus, the discharge pulse DPB2 of the driving signal COM2 is generated later than the pulse DPA2 of the driving signal COM1 by Δt.

Disadvantageously, in situations where discharge pulse DPA1 and DPA2 are used in adjacent nozzles, there is a possibility that discharge of the other nozzle will have an influence on discharge of the one nozzle.

By way of contrast, the configuration of the present invention will be described in more detail, using FIG. 2 as a reference. The first driving signal COM1 comprises a first medium-sized dot discharge pulse DPM1 which is generated in the period T11 along with a second medium-size dot discharge pulse DPM2 which is generated in the period T12. The discharge pulses DPM1 and DPM2 each have waveforms of the same shape and include an expansion component P11 (corresponding to a pressure chamber expansion), an expansion hold component P12, a contraction component P13 (corresponding to the contraction of the pressure chamber), damping hold component P14, and an expansion damping component P15. The first expansion component P11 is a waveform component in which a potential is raised to an expansion potential VH1 from a reference intermediate potential VHB at a comparatively constant low rate so as not to discharge the ink droplets. The first expansion hold component P12 is a waveform component in which the first expansion potential VH1 is constantly held. The first contraction component P13 is a waveform component in which the potential drops to a contraction potential VL1 from the expansion potential VH1 at a comparatively high rate. The damping hold component P14 is a waveform component in which the contraction potential VL1 is held for a predetermined period. The expansion damping component P15 is a waveform component in which the potential is recovered to the intermediate potential VHB from the first contraction potential VL1 at a comparatively constant low rate so as not to discharge the ink droplets.

When the first medium-size dot discharge pulse DPM1 or the second medium-size dot discharge pulse DPM2 described above is supplied to the piezoelectric vibrator 20, the piezoelectric vibrator 20 is contracted in a longitudinal direction by the first expansion component P11 and the pressure chamber 28 expands from the reference volume corresponding to the intermediate potential VHB to an expansion volume corresponding to the expansion potential VH1. During the expansion, ink is supplied to the pressure chamber 28 from the reservoir 26 through the ink supply port 27. This state is held during the expansion hold component P12 of the pulse. During the contraction component P13, the piezoelectric vibrator 20 is extended by contracting the pressure chamber 28 rapidly from the expansion volume to contraction volume corresponding to the contraction potential VL1. The ink of the pressure chamber 28 is pressurized by the rapid contraction of the pressure chamber 28 and thus, ink droplets having a volume corresponding to that of medium-size dots are discharged from the nozzle openings 25.

The contraction state of the pressure chamber 28 is held during the damping hold component P14 and the pressure of the pressure chamber 28, which has been decreased by the discharge of the ink droplets is raised again by natural vibration. During the expansion damping component P15, the pressure chamber 28 is expanded back to the reference volume and thus, pressure variation of the ink in the pressure chamber 28 is absorbed.

In the second driving signal COM2, a small dot discharge pulse DPS is generated in the period T21, which includes a first expansion component P21, a first expansion hold component P22, a contraction component P23, a contraction hold component P24, a second expansion component P25, a second expansion hold component P26, a second contraction component P27, a damping hold component P28, and a expansion damping component P29. The first expansion component P21 is a waveform component in which the potential is raised to the first expansion potential VH2 from the intermediate potential VHB and the first expansion hold component P22 is a waveform component in which the first expansion potential VH2 is constantly held. The first contraction component P23 is a waveform component in which the potential drops rapidly from the first expansion potential VH2 to first intermediate potential VM1. The contraction hold component P24 is a waveform component in which the first intermediate potential VM1 is constantly held, the second expansion component P25 is a waveform component in which the potential is raised to second intermediate potential VM2 from the first intermediate potential VM1, and the second expansion hold component P26 is a waveform in which the second intermediate potential VM2 is constantly held. The second contraction component P27 is a waveform component in which the potential consistently drops to the contraction potential VL2 from the second intermediate potential VM2 at a comparatively high rate. The second damping hold component P28 is a waveform component in which the contraction potential VL2 is constantly held. The expansion damping component P29 is a waveform component in which the potential is constantly recovered to the intermediate potential VHB from the contraction potential VL2 at a comparatively low rate so as not to discharge the ink droplets.

When the small dot discharge pulse DPS is supplied to the piezoelectric vibrator 20, the piezoelectric vibrator 20 is contracted sharply in a longitudinal direction by the first expansion component P21 and thus, the island section 34 is displaced in a direction away from the pressure chamber 28. Due to the displacement of the island section 34, the pressure chamber 28 is expanded rapidly from the reference volume to expansion volume corresponding to the first expansion potential VH2. the expansion of the pressure chamber 28 causes a comparatively strong negative pressure in the pressure chamber 28 and causing the ink to travel from the reservoir 26 to the pressure chamber 28. The expansion state of the pressure chamber 28 is held during supply of the first expansion hold component P22. Then, is the direction of the meniscus is changed during the first expansion hold component P22 and the central part thereof is inflated into a column shape.

Thereafter, the first contraction component P23 is supplied and the piezoelectric vibrator 20 is extended. During the extension of the piezoelectric vibrator 20, the island section 34 is rapidly displaced in a direction adjacent to the pressure chamber 28. Due to the displacement of the island section 34, the pressure chamber 28 is contracted rapidly, decreasing the volume thereof from the expansion volume to a volume corresponding to the first intermediate potential VM1. The ink of the pressure chamber 28 is pressurized by the rapid contraction of the pressure chamber 28. In addition, the contraction hold component P24 is supplied and the discharge volume is held for a short time. The piezoelectric vibrator 20 is contracted by the second expansion component P25 and thus, the volume of the pressure chamber 28 is slightly increased again. The piezoelectric vibrator 20 is extended by the second contraction component P27 through the second expansion hold component P26 and thus, the volume of the pressure chamber 28 is rapidly decreased again and the ink is discharged as ink droplets having a volume corresponding to that of the small dots during supply of the third contraction component P27 from the contraction hold component P24. Thereafter, due to supply of the damping hold component P28 and the expansion damping component P29, the pressure chamber 28 is expanded back to the reference volume and the pressure variation of the ink in the pressure chamber 28 is absorbed.

In the second driving signal COM2, the large dot discharge pulse DPL generated in the period T22 includes an expansion component P31, a expansion hold component P32, a contraction component P33, a damping hold component P34, and a expansion damping component P35. The expansion component P31 is a waveform component in which potential is raised to the expansion potential VH3 from the intermediate potential VHB consistently at a comparatively low rate so as not to discharge the ink droplets. The expansion hold component P32 is a waveform component in which the expansion potential VH3 is constantly held. The contraction component P33 is a waveform component in which the potential drops to contraction potential VL3 from the expansion potential VH3 consistently at a comparatively high rate. The damping hold component P34 is a waveform component in which the contraction potential VL3 is held for a short period. The expansion damping component P35 is a waveform component in which the potential is recovered to the intermediate potential VHB from the contraction potential VL3.

When the large dot discharge pulse DPL configured as above is supplied to the piezoelectric vibrator 20, first, the piezoelectric vibrator 20 is contracted in a longitudinal direction by the expansion component P31. The pressure chamber 28 then expands from the reference volume corresponding to the intermediate potential VHB to an expanded volume corresponding to the expansion potential VH3. During the expansion, the ink is drawn into the pressure chamber 28 from the reservoir 26 through the ink supply port 27. The expansion state of the pressure chamber 28 is held during the supply of the expansion hold component P32. Thereafter, the contraction component P33 is supplied and the piezoelectric vibrator 20 is extended. By the extension of the piezoelectric vibrator 20, the pressure chamber 28 is contracted rapidly from the expansion volume to contraction volume corresponding to the contraction potential VL3. The ink in the pressure chamber 28 is pressurized by the rapid contraction of the pressure chamber 28 and thus, ink droplets having a volume corresponding to that of large dots are discharged from the nozzle openings 25. Thereafter, the damping hold component P34 is supplied along with the expansion damping component P35, wherein the pressure chamber 28 is expanded back to the reference volume and the pressure variation of the ink in the pressure chamber 28 is absorbed.

In this embodiment, the start of the discharge pulse, referred to as the generation timing of the first medium-size dot discharge pulse DPM1 in the first driving signal COM1 corresponds with the generation timing of the small dot discharge pulse DPS in the second driving signal COM2. Unfortunately, however, the a generation timing tm1 of the second medium-size dot discharge pulse DPM2 and the generation timing tm2 of the large dot discharge pulse DPL in the second riving signal COM2 do not correspond. That is to say, as shown in FIG. 2, the large dot discharge pulse DPL is generated later than the second medium-size dot discharge pulse DPM2 by a time represented by Δt.

Figure 4:
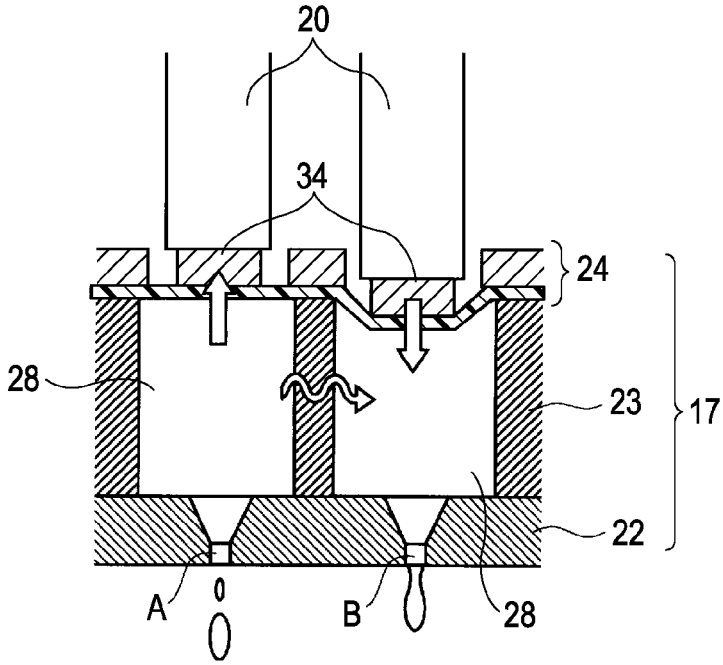
FIG. 4 is a diagram illustrating of the transfer of pressure vibration at the time of driving a piezoelectric vibrator.

The recording head 8 of the present invention has a decreased size and weight. Therefore, as previously mentioned, the thicknesses of partitions partitioning the pressure chambers 28 adjacent to each other is reduced. As a result, as shown in FIG. 4, pressure vibration produced in the ink of the pressure chamber 28 by driving the piezoelectric vibrator 20 may be transmitted to an adjacent pressure chamber 28 through the partition. In situations where the ink droplets are discharged from the nozzle openings 25 adjacent to each other at the same time, phases of the pressure vibrations on both sides agree with each other, meaning that there is no influence of the pressure vibration. However, as described above, in situations where the discharge timings of the nozzle openings 25 adjacent to each other are different, the pressure vibration may influence the discharging from adjacent nozzles.

For example, in a certain recording period, assuming that the piezoelectric vibrator 20 corresponding to one nozzle opening 25, shown in FIG. 4 as nozzle A, is driven by the second medium-size dot discharge pulse DPM2, and that a second piezoelectric vibrator 20 corresponding to a second nozzle B is driven by the large dot discharge pulse DPL, the discharge timing in the nozzle B will be later than that in the nozzle A. In this case, the vibration of pressure chamber 28 corresponding to the nozzle A is transmitted to the pressure chamber 28 corresponding to the nozzle B through the partition. Thus, the velocity of the droplets as they leave the nozzle B, known as the flying velocity Vm, may be slower than the flying velocity Va of the droplets without the interfering vibration.

Disadvantageously, when the flying velocity of the ink droplets is decreased, the ink droplets may enter a mist state and fail to accurately hit the discharge target, resulting in deteriorated image quality.

Figure 5:
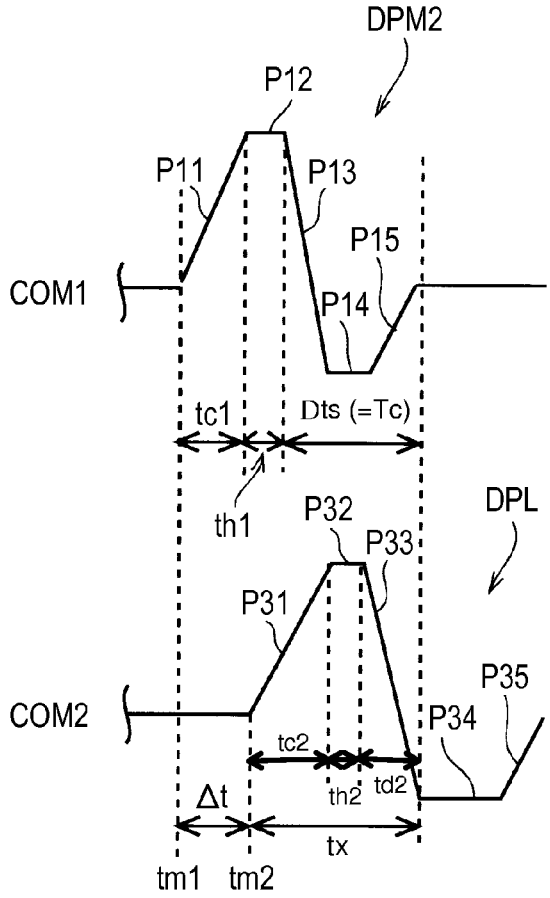
FIG. 5 is a diagram illustrating the delay time of a generation timing between a second medium-size discharge pulse and a large dot discharge pulse.

In order to overcome these problems, in the printer 1 according to the invention, the displacement (delay time) Δt on a time axis between the generation timing tm1 of a medium-size dot discharge pulse DPM2 in the first driving signal COM1 and the generation timing tm2 of the large dot discharge pulse DPL in an adjacent nozzle is optimized. This allows the flying velocities of the ink droplets discharged from both nozzle openings 25 to achieve the target flying velocity Va even when the ink droplets are discharged from adjacent nozzle openings 25 in the same recording period. Specifically, as shown in FIG. 5, the delay time Δt, or the time from the starting point tm1 of the expansion component P11 of the second medium-size dot discharge pulse DPM2 to the starting point tm2 of the expansion component P31 of the large dot discharge pulse DPL, is set so that the displacement Δts between a start point of the contraction component P13 and the end point of the contraction component P33 corresponds with the characteristic vibration period Tc of the ink in the pressure chamber 28.

Figure 6:
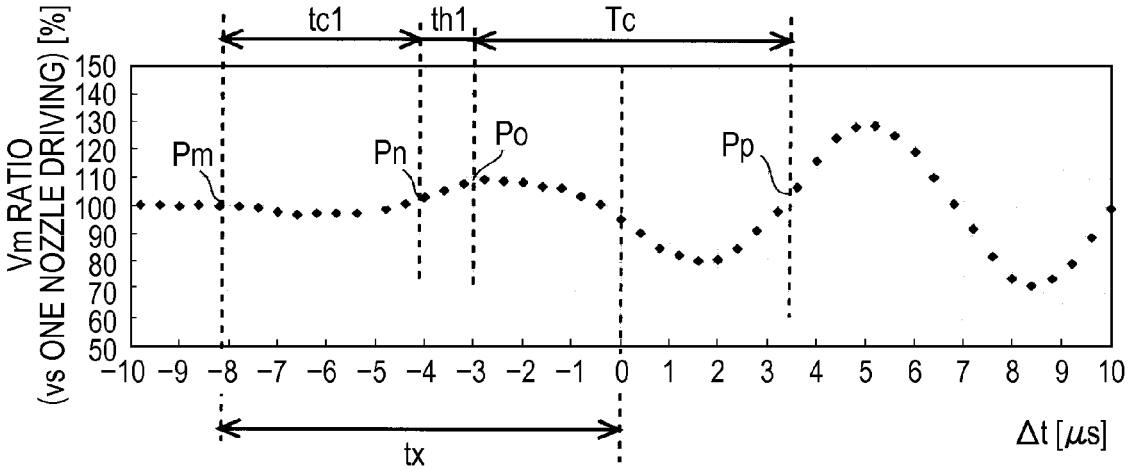
FIG. 6 is a graph illustrating a change of flying velocity of ink droplets at various delay times.

FIG. 6 is a graph illustrating the flying velocity Vm (m/s) of the ink droplets in the nozzle B at various delay times Δt (μs) between the generation timings of the second medium-size dot discharge pulse DPM2 and the large dot discharge pulse DPL when the ink droplets are discharged adjacent nozzles during the same recording period, wherein the second medium-size dot discharge pulse DPM2 is used for the nozzle A and the large dot discharge pulse DPL is used for the nozzle B. In FIG. 6, the flying velocity Vm is represented in a ratio (%) to the target flying velocity Va. When the delay time Δt has a value of 0, the second medium-size dot discharge pulse DPM2 and the large dot discharge pulse DPL are generated at the same time and when the delay time Δt has a minus value, the large dot discharge pulse DPL is generated earlier than the second medium-size dot discharge pulse DPM2.

As shown in FIG. 6, the flying velocity Vm of the ink droplets varies periodically after the border point Pm, and is substantially similar to the target flying velocity Va (100%) when the delay time Δt is set to less than border point Pm. Thus, the discharge of the nozzle A has no influence on the nozzle B before the generation period tx of the large dot discharge pulse DPL, meaning that there is no interference before the generation period tx matches the generation period of the second medium-size dot discharge pulse DPM2. Conversely, the pressure vibration produced by the discharge of the nozzle A does have an influence on the nozzle B when the generation period tx matches the generation period of the second medium-size dot discharge pulse DPM2. Accordingly, the delay time Δt corresponding to the border point Pm is acceptable only before the generation period tx. The generation period tx can be written by tx=tc2+th2+td2 when the tc2 represents the generation period of the expansion component P31, th2 represents the generation period of the expansion hold component P32, and td2 represents the generation period of the contraction component P33.

When the delay time is set past the border point Pm, since the pressure vibration in the pressure chamber 28 is excited at the time when the piezoelectric vibrator 20 on the nozzle A side is driven by the second medium-size dot discharge pulse DPM2, the flying velocity Vm of the ink droplets is faster or slower than the target flying velocity Va depending on amplitude of the pressure vibration. That is to say, when the ink droplets are discharged from the nozzle B at a timing when the pressure vibration is displaced in a direction opposite the discharge direction, the flying velocity of the ink droplets is decreased, while when the ink droplets are discharged from the nozzle B at a timing when the pressure vibration is displaced in the discharge direction, the flying velocity of the ink droplets increases. A variation curve of the flying velocity Vm substantially agrees with a waveform of the pressure vibration produced in the ink of the pressure chamber 28.

Assuming that the variation of the flying velocity Vm shown in FIG. 6 corresponds to the pressure vibration produced in the ink of the pressure chamber 28, the pressure chamber 28 is expanded by the first expansion component P11 between the point Pm and a point Po, wherein pressure chamber 28 causes the ink to vibrate according to a natural vibration period Tc. After the point Po, a natural vibration period Tc is generated when the ink of the pressure chamber is pressurized and discharged by means of the first contraction component P13.

Figure 7A:
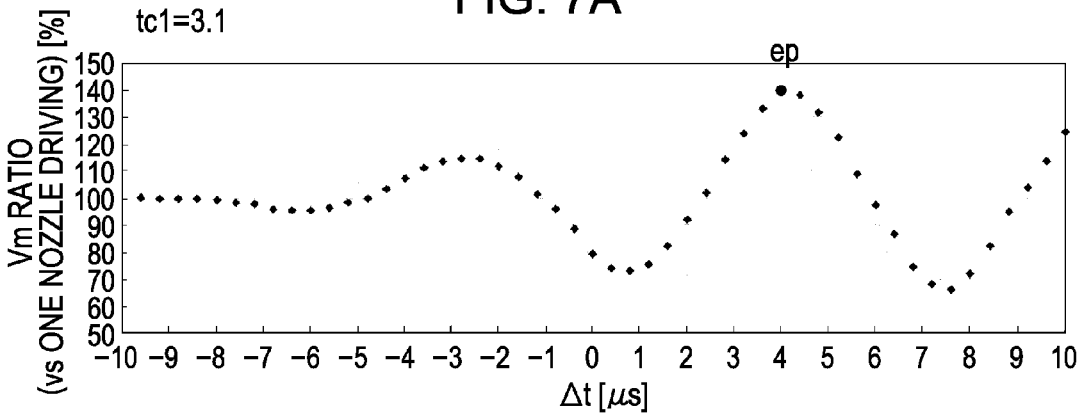
FIGS. 7A to 7C are diagrams illustrating the flying velocity at the various generation periods of a first expansion component of a second medium-size discharge pulse.
Figure 7B:
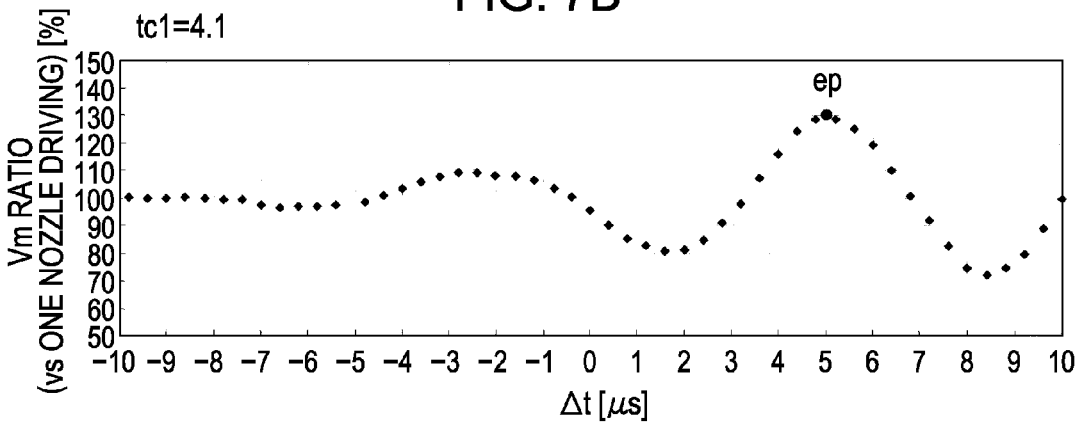
Figure 7C:
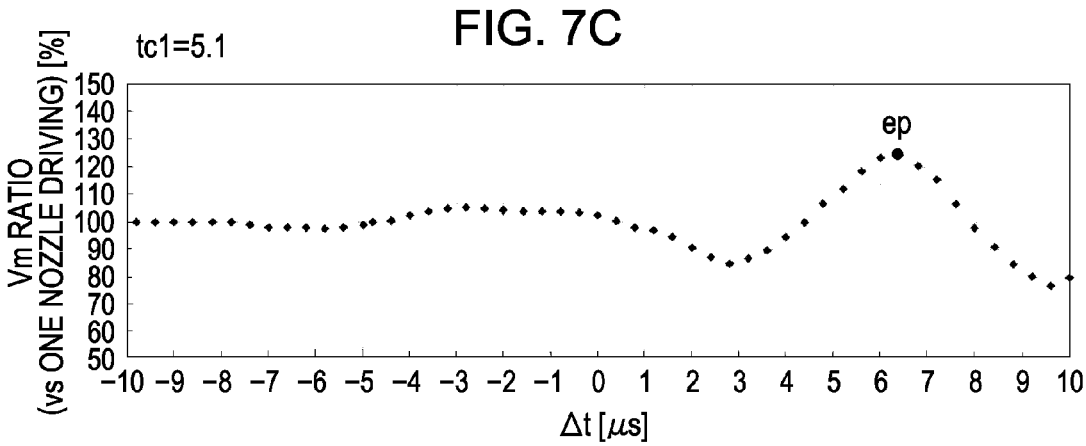
Figure 8A:
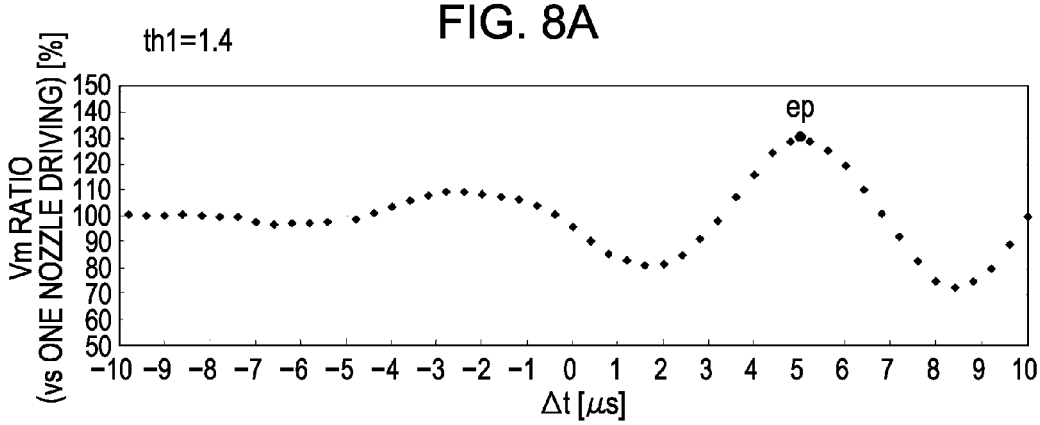
FIGS. 8A to 8C are diagrams illustrating the flying velocity at a variety of generation periods for a first expansion hold component of a second medium-size discharge pulse.
Figure 8B:
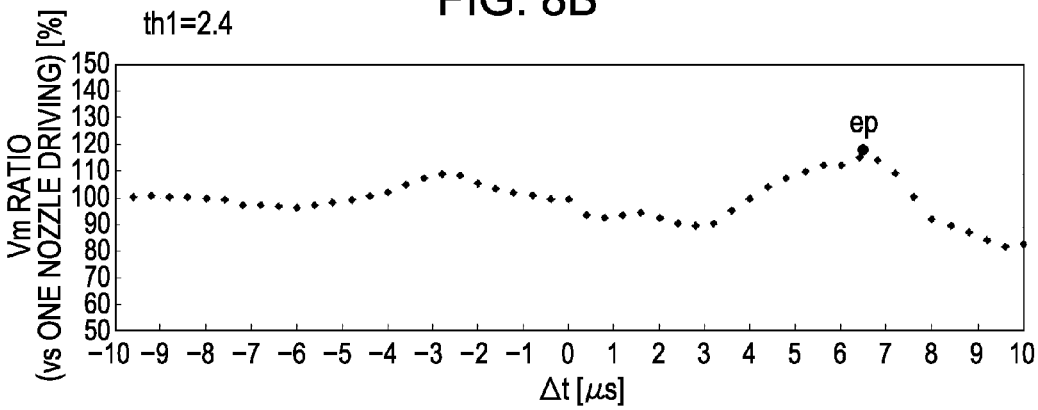
Figure 8C:
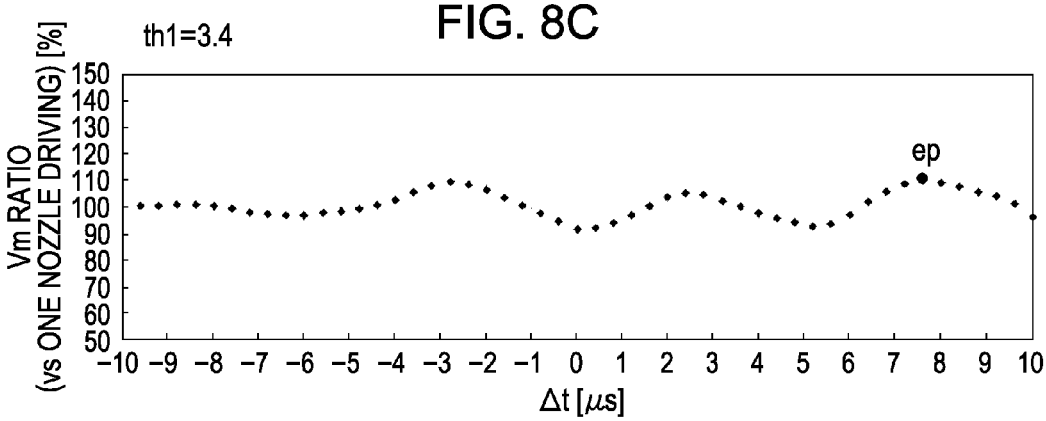
Figure 9A:
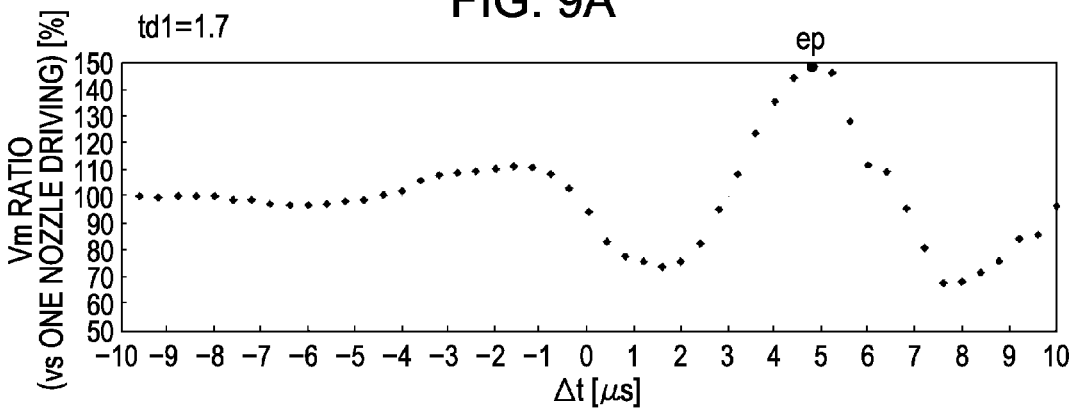
FIGS. 9A to 9C are diagrams illustrating the flying velocity at various generation periods for a first contraction component of a second medium-size discharge pulse.
Figure 9B:
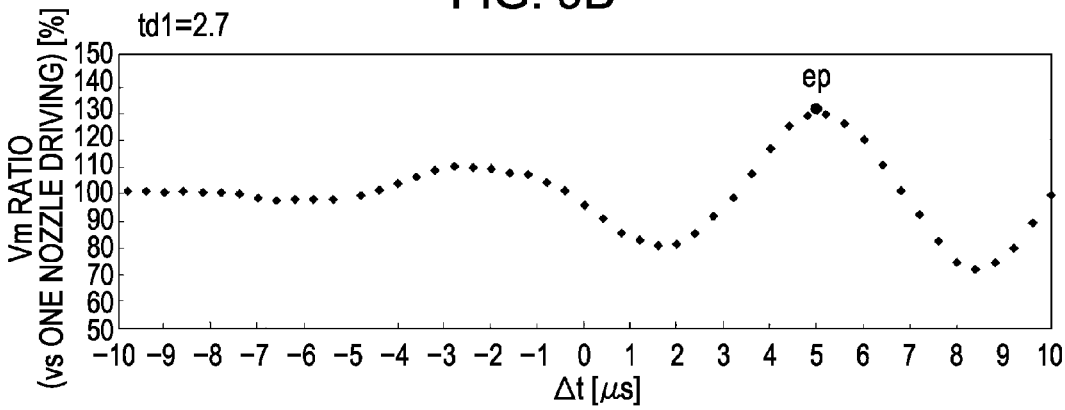
Figure 9C:
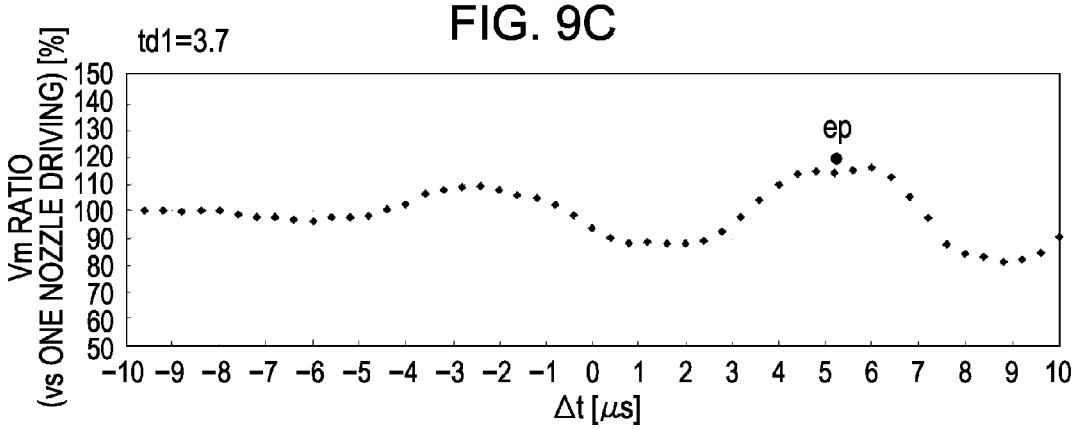

Here, the phase of the pressure vibration depends on the generation period tc1 of the expansion component P11 and the generation period th1 of the expansion hold component p12 of the second medium-size dot discharge pulse DPM2. FIGS. 7A to 7C, 8A to 8C, and 9A to 9C are diagrams illustrating various flying velocities Vm when the generation period of a waveform component of the second medium-size dot discharge pulse DPM2 is changed, and may be referred to hereinafter as waveform diagrams of the pressure vibration produced in the ink of the pressure chamber. FIGS. 7A to 7C illustrate the change in the flying velocity Vm when the generation period tc1 of the first expansion component P11 is changed, FIGS. 8A to 8C illustrate the change of the flying velocity Vm when the generation period th1 of the first expansion hold component P12 is changed, and FIGS. 9A to 9C illustrate the change of the flying velocity Vm when the generation period td1 of the first contraction component P13 is changed. The generation period of each of the components is increased in the order of FIGS. 7A to 7C, 8A to 8C, and 9A to 9C, respectively.

The maximum value ep specified in FIGS. 7A to 7C, 8A to 8C, and 9A to 9C, changes in size and position when the generation period tc1 of the first expansion component P11 and the generation period th1 of the first expansion hold component P12 are changed. Specifically, as values of tc1 and th1 increase, the generation of the maximum value ep occurs later. That is to say, as the values of tc1 and th1 become larger, the variation curve phase occurs later. On the contrary, when the generation period td1 of the first contraction component P13 is changed, a phase of the variation curve is not significantly changed whereas amplitude of the variation curve is changed (FIGS. 9A to 9C).

In consideration of the configuration, the target flying velocity Va can be acquired (Vm 100% in FIG. 6) at a point Pp after the generation period tc1, the generation period th1, and the characteristic vibration period Tc from the border point Pm. That is to say, the amplitude of the pressure vibration becomes 0 at the point Pp. Accordingly, in the printer 1 according to the invention, the delay time Δt is determined by Δt=tc1+th1+Tc−(tc2+th2+td2).

In accordance with the expression, the displacement Δts (FIG. 5) on the time axis between the start point of the first contraction component P13 of the second medium-size discharge pulse DPM2 and the end point of the fourth contraction component P33 which is the discharge component of the large dot discharge pulse DPL becomes the delay time Δt which agrees with the characteristic vibration period Tc.

Even when the ink droplets are discharged from each of the nozzles in the same recording period by using the second medium-size discharge pulse DPM2 in a nozzle(the nozzle A) adjacent a second nozzle (nozzle B) using the large dot discharge pulse DPL, the amplitude of the pressure vibration produced by the discharge of one nozzle A becomes almost 0, when the delay time Δt calculated above is used between a generation timing of the large dot discharge pulse DPL as the second discharge pulse and a generation timing of the second medium-size discharge pulse DPM2 is set.

Accordingly, it is possible to suppress the influence of the pressure vibration. As the result, the flying velocity of the ink droplets on the nozzle B can achieve the flying velocity of the ink droplets when the ink droplets are discharged without any interference from adjacent nozzles (target flying velocity Va). As the result, the ink droplets refrain from entering a mist state and the flying curve is suppressed, and it is possible to hit the ink droplets onto the discharge target with high precision.

Because the ink droplets have a small volume, the flying curve may be easily influenced by any pressure vibration produced by a discharge from the adjacent nozzle openings 25. Accordingly, a large dot discharge pulse DPL corresponding to the second discharge pulse causes liquid droplets with a volume larger than that of ink droplets which are discharged by the second medium-size discharge pulse DPM2 which correspond to the first discharge pulse. That is, the second medium-size discharge pulse DPM2 results in liquid droplets which are comparatively smaller in volume than previously generated during the large dot discharge pulse DPL, making it possible to prevent the situation where the pressure vibration produced by the discharge of the adjacent nozzle openings 25 at the time of discharging results in ink droplets with a small volume. In situations where the ink droplets are discharged from the nozzle openings 25 in the middle of a discharge generation period, the delay time At is preferably determined by $$\Delta t = tc1 + th1 + Tc - (tc2 + th2 + td2 - \alpha)$$

where $\alpha$ is set to a range represented by $0 \leqq \alpha \leqq td2$.

That is to say, in the modified example, the delay time $\Delta t$ corresponds to the generation time td2 of the contraction component P33 by means of $\alpha$. The discharging timing of the ink droplets can agree with the timing when the amplitude of the pressure is almost 0 as much as possible by optimizing $\alpha$, making it possible to suppress the influence of the pressure vibration more surely.

However, the invention is not limited to the embodiments, but various modifications may occur insofar as they are within the scope of the appended claims.

Waveform configurations of the driving signals COM1 and COM2 are not limited to those exemplified in the embodiments, but the invention can be applied to driving signals having various configurations. For example, when the first driving signal COM1 may include a first discharge pulse that is a small dot discharge pulse, and a third discharge pulse, that is a medium-size discharge pulse, which causes liquid droplets with a larger volume than that of the liquid droplets discharged by the first discharge pulse and the second driving signal COM2 includes a second discharge pulse that is a large dot discharge pulse, and a fourth discharge pulse which is a small dot discharge pulse, which causing liquid droplets with a smaller volume than the larger discharge pulse, it is efficient to have the first discharge pulse be generated later than the third discharge pulse in the first driving signal COM1 and the second discharge pulse be generated later than the fourth discharge pulse in the second driving signal COM2, with the third discharge pulse of the driving signal COM1 and the fourth discharge pulse of the second driving signal COM2 being generated at the same time.

That is to say, in this configuration, it is assumed that the ink droplets are discharged from the nozzle openings 25 during the same recording period by using the third discharge pulse and the fourth discharge pulse for adjacent nozzle openings 25, so that the discharging timings of the both nozzles substantially agree with each other. Thus, it is further assumed the ink droplets discharged using the first discharge pulse and the second discharge pulse for adjacent nozzle openings 25, so that the discharge timing of the ink droplets on the nozzles agree with the timing when the amplitude of the pressure vibration from the one nozzle opening is almost 0. This makes it is possible to prevent the influence of the pressure vibration from the nozzles where the ink droplets are of smaller volume.

The invention can be also applied to a configuration in which one driving signal includes three or more discharge pulses.

The invention may be used in any liquid ejecting apparatus capable of performing a discharge control by using the plurality of driving signals, meaning that the invention is not limited to a printer, and may be applied to various ink jet recording apparatus such as plotters, facsimile equipment, copy machines, as well as liquid ejecting apparatuses other than the recording apparatuses such as display manufacturing apparatuses, electrode manufacturing apparatuses, and chip manufacturing apparatuses.

What is claimed is:

1. A liquid ejecting apparatus, comprising:

a liquid ejecting head including, a pressure chamber provided in communicating with a nozzle opening, and a pressure generating unit capable of changing a pressure of liquid contained in the pressure chamber; and a driving signal generating unit capable of generating a first driving signal and a second driving signal, the first driving signal and second driving signal including a plurality of discharge pulses having a expansion component expanding the pressure chamber and a contracting component contracting the pressure chamber, wherein the first driving signal including a first discharge pulse and a second discharge pulse generating after the first discharge pulse;

the second driving signal including a third discharge pulse and a fourth discharge pulse generating after the third discharge pulse;

the beginning of the fourth discharge pulse is generated after the beginning of the second discharge pulse; and a period of time between the beginning of the contracting component of the second discharge pulse and the end of the contracting component of the fourth discharge pulse is corresponded to a characteristic vibration period of a liquid contained in the pressure chamber.

2. The liquid ejecting apparatus according to claim 1, wherein the forth discharge pulse causes discharge of liquid droplets with a volume larger than the liquid droplets discharged by the second discharge pulse to be discharged.

* * * * *